US006848984B2

(12) United States Patent
Böhler

(10) Patent No.: US 6,848,984 B2
(45) Date of Patent: Feb. 1, 2005

(54) DEVICE FOR THE TREATMENT OF SURFACES

(75) Inventor: Daniel Böhler, Denzlingen (DE)

(73) Assignee: Gunther Bohler GmbH (DE)

( * ) Notice: Subject to any disclaimer, the term of this patent is extended or adjusted under 35 U.S.C. 154(b) by 0 days.

(21) Appl. No.: 10/338,418

(22) Filed: Jan. 8, 2003

(65) Prior Publication Data

US 2004/0132392 A1 Jul. 8, 2004

(30) Foreign Application Priority Data

Jan. 8, 2002 (DE) ..... 102 00 381

(51) Int. Cl.[7] ..... B24B 41/00

(52) U.S. Cl. ..... 451/360; 451/344; 451/342; 451/359

(58) Field of Search ..... 451/360, 357, 451/359, 487, 344, 363, 442, 356

(56) References Cited

U.S. PATENT DOCUMENTS 5,947,804 A * 9/1999 Fukinuki et al. ..... 451/357
6,132,300 A * 10/2000 Martin ..... 451/357
6,159,084 A * 12/2000 Tiede ..... 451/357
6,343,982 B1 * 2/2002 Sun ..... 451/357
2003/0104773 A1 * 6/2003 Krondorfer et al. ..... 451/342

* cited by examiner

*Primary Examiner*—Lee D. Wilson
(74) *Attorney, Agent, or Firm*—Welsh & Katz, Ltd.

(57) ABSTRACT

This device for the treatment of surfaces is specifically conceived as an addition to motor-driven hand tools. It includes a device mounting that can be installed securely in position on a housing component of a motorized driving unit in such a way as to be removable at will. The device also includes a tool mounting, which is designed specifically for an instrument that rubs and polishes surfaces. The device further includes a peripheral component, extending from the center, which is connected to the tool mounting in a manner such that the turning of the peripheral component, around a rotation axis, of this peripheral component sets the tool mounting in motion. The tool mounting is mounted in relation to the device mounting, in a manner such that it can be tilted, and a mechanism is envisioned, which will basically prevent the tool mounting from turning about on the rotation axis of the peripheral component, and which will simultaneously allow for the tilting of the tool reception. With this appliance, which only requires minimal need for the manual skills of a human operator, it is possible to work on surfaces with ease, even in difficult-to-reach corner areas, especially on surfaces that are curved in either concave or convex fashion, and specifically with a tool designed for rubbing or polishing surfaces.

20 Claims, 1 Drawing Sheet

DEVICE FOR THE TREATMENT OF SURFACES

BACKGROUND OF THE INVENTION

The present invention is generally directed to a device that is used for the treatment of various surfaces, particularly those that exhibit any degree of curvature and, more particularly, an instrument employed for rubbing or polishing, where the device is specifically envisioned as an addition to motorized hand tools, such as polishing instruments, power drills, and so on.

Machines for working on surfaces by means of a motorized rubbing or polishing disk are quite familiar, and come in various designs. These include, for example, the so-called oscillating or rotating variety of rubbing device, in which a support for the mounting of the actual tool, i.e., the sandpaper, is set in motion by means of a motor-driven, centrally rotating hub. As a general rule, the support site for the tool is positioned in the instrument casing in a manner that allows for back-and-forth movement, but its movability is ordinarily not such as would allow the rubbing surface to be applied to surfaces that curve in a concave or convex fashion.

By the use of such familiar machines, this can only be accomplished by means of changing the position of the whole machine, since the mode of operation of the rubbing device, as well as the manner in which it engages with the surface, can only be determined by the specific way in which the human operator controls the position of this device. As a consequence of this, a constant manual guidance and watchfulness are required vis-à-vis the positioning and operation of the rubbing device. Also, with regards to the force exerted upon the surface being worked on, for which reason, in working with machines of the familiar sort, it is not only necessary that the human operator possess a high degree of experience and proficiency, in order to maintain the tool in a uniform operating mode, but also, curved surfaces in part cannot be uniformly and effectively treated at all, or at least not in a satisfactory manner.

This problem has already been thoroughly resolved by means of a device that is described in DE 44 47 162 A. In this reference, three tool mountings in the form of plates for either a rubbing or polishing mechanism, are arranged in a triangular fashion. Each mounting can be driven around a longitudinal axis in order to effectuate the desired rotation, where the tool reception points for the tool mountings are installed independently of one another within the housing—and in such a way as to be movable on a mounting—for the universal turning motion of the rotation axis within the limits of a pre-determined sphere of motion, designated as "alpha."

Each of the mountings possesses an exterior surface with an outer contour that is similar to a ball segment, which is movably received in a reception point in the housing with an inner contour that is comparable to ball segment. A driving mechanism of the machine possesses a movable ball-joint junction point, over which this drive mechanism is connected, or can be connected, with the respective tool mountings, in order to drive it into rotation in each possible positions of motion. The individual tool mountings, as well as the plates, can be decreased for exchange at the ball-joint junction point. There still remains, however, the prevalent problem of rotating tool receptions in the case of rubbing/polishing operations in general, namely that working into corners is not possible.

It is certainly true that oscillating, pendulum-type rubbing devices—possessing plates especially designed for working into corners—are also known; however, in this case, we have to do again with special appliances that have their own drive mechanism, which on the one hand are intended only for working in corners, and, thus, for example, comparatively expensive for a do-it-yourselfer in relation to the sphere of employment, and on the other hand, they are not particularly suitable for curved surfaces.

BRIEF DESCRIPTION OF THE DRAWINGS

The benefits and advantages of the present invention will become more readily apparent to those of ordinary skill in the relevant art after reviewing the following detailed description and accompanying drawings wherein.

DETAILED DESCRIPTION OF THE INVENTION

Figure 1:
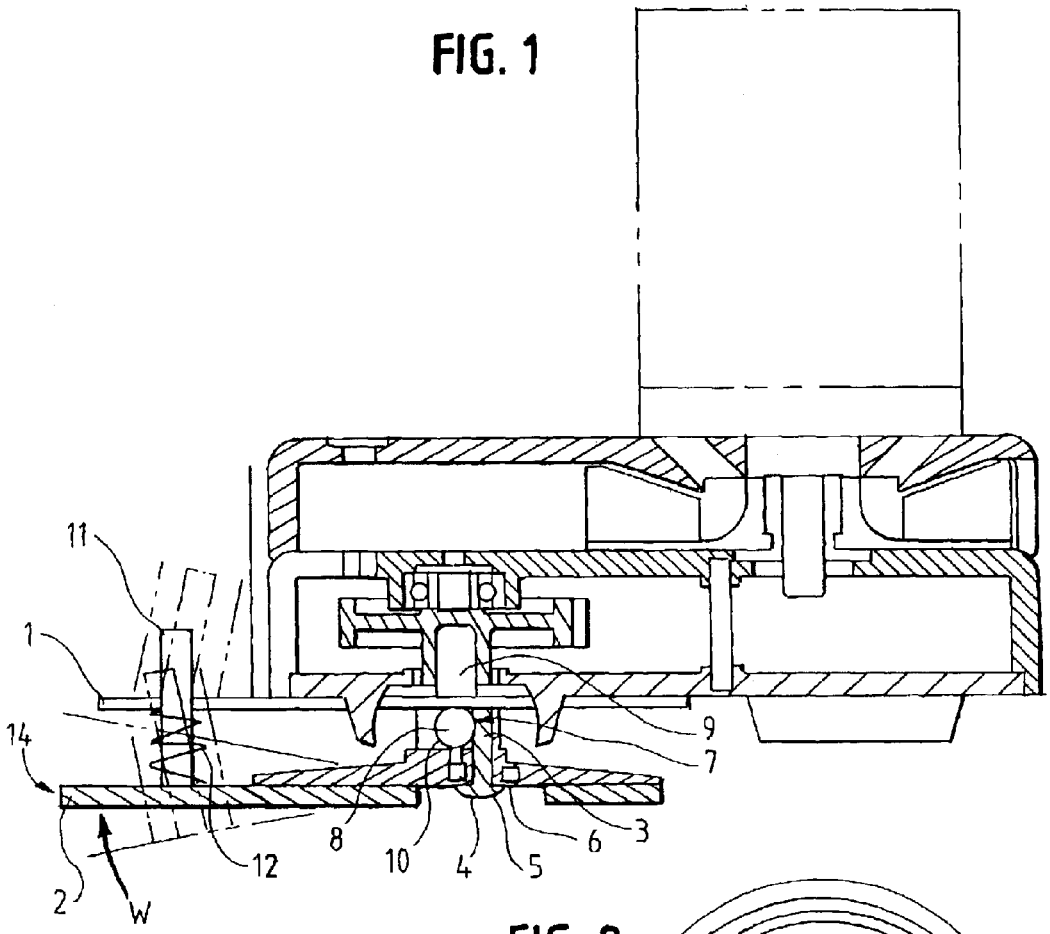
FIG. 1 is a partially sectioned lateral view of a device for the treatment of surfaces, which is built on a rubbing/polishing machine with three rotating tool reception sites.
Figure 2:
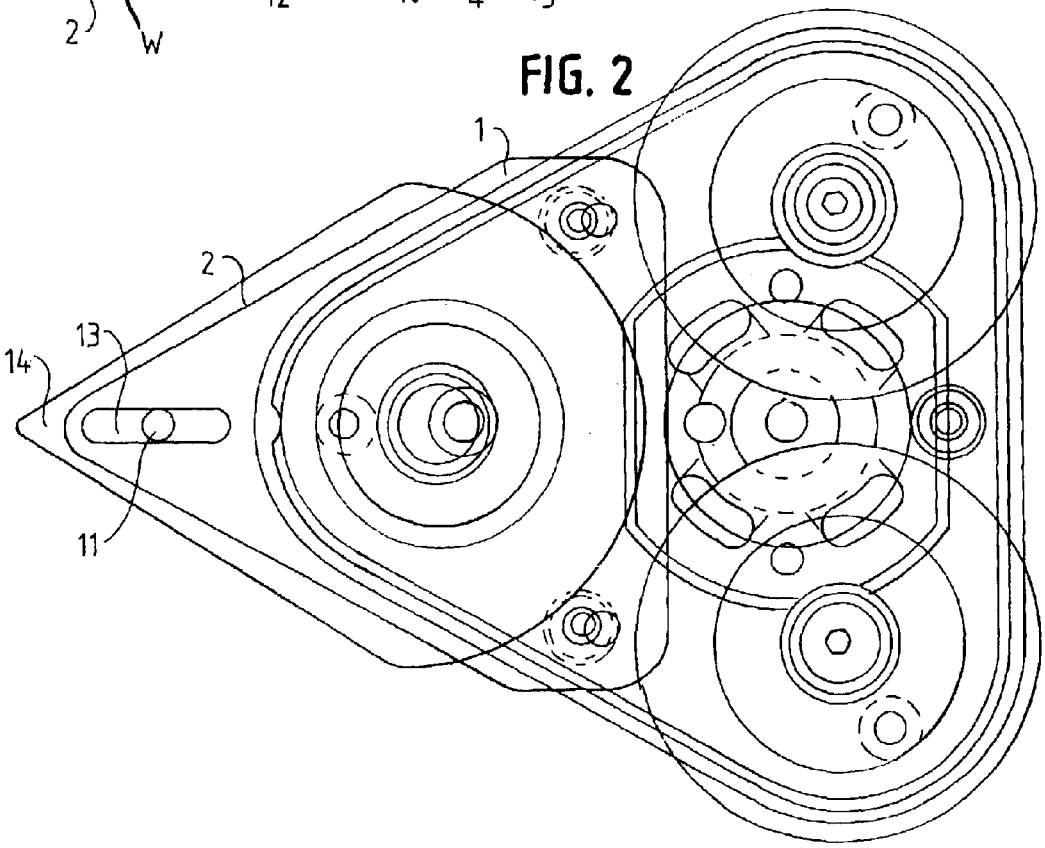
FIG. 2 is a view on the underside of the combination of FIG. 1.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, not should be inferred to the limit of the subject matter disclosed herein.

All patents referred to herein, are hereby incorporated herein by reference, whether or not specifically to do so within the text of this disclosure.

In the present disclosure, the words "a" or "an" are to be taken to include both the singular and the plural. Conversely, any reference to plural items shall, where appropriate, include the singular.

The task of the present invention is to prepare a device for working on surfaces, which is designed as an attachable appliance for already familiar hand tools with rotary drive mechanisms, preferably for the above-described rubbing/polishing device for curved surfaces, which, consequently, has no need of a separate drive mechanism of its own, and makes it possible to treat both corners and curved surfaces in one operation.

The device that is designed in accordance with this invention simply makes possible an expansion of the functionality of machines that have rotating tool reception sites, indicating that on the one hand a rotary movement is converted into an oscillatory movement, so that the work of rubbing or polishing can be taken care of, and furthermore, so that the same thing may also be carried out in corner regions as well as on curved surfaces. Special advantages result from the combination of the device conforming to this invention with the rubbing/polishing machine—well-known from DE 44 47 162 A—which possesses either one or several tool reception sites that are universally turnable, as well as a drive mechanism.

The device for treating surfaces—formed in accordance with the invention and exhibited in FIG. 1—is represented in a condition in which it is built onto one of the tool reception sites of the rubbing/polishing machine already elucidated above, in keeping with DE 44 47 162 A.

The device consists of a plate-like device mounting, 1, which can be secured in position on a housing component of a drive unit, as well as that of a machine, preferably in a manner that allows for removal at will. As an example, the device mounting, 1, is screwed onto the underside of the rubbing/polishing machine. Alternatively, this device mounting can also be secured in place, in specially prepared rest openings in the machine housing, or clamped firmly onto the housing.

In accordance with the representation, a flat tool mounting, 2, is to be found underneath the device mounting, 1. This latter serves as an work surface, as well as rubbing plate for the securing in place of the actual tool, and thus, for example, of the rubbing or polishing layer. The tool mounting possesses in addition an essentially flat outer side, which serves as a placement surface for the rubbing or polishing layer, and which preferably as seen in its entirety in the view of FIG. 1, has approximately the shape of a circle segment.

As regards selection of the shape, it is crucial that the outer side possess at least one apex, which—after placement of the device on the machine—projects outward laterally over the housing, and which in the mode of implementation is formed by means of two lateral edges that enclose a sharp angle between themselves. The apex, 14, is rounded off and, when the device is in use, serves as the part that can be moved inward into the angles and corners of a surface to be worked on.

The rubbing or polishing layer is installed on the flattened outer side of the tool mounting in a removable manner, in order to make possible a simple exchange of the rubbing/polishing medium after it has become worn out. For this purpose there are several well-known mediums available, such as either a flat or punctiform adhesive joint, a border joint, or the more recently developed interlocking micro-replications. Furthermore, as an alternative, the possibility of clamping devices such as clamp levers, and the like, which can be designed for lateral positioning or on the upper side of the tool mounting. Lastly, what is decisive for selection of an appropriate medium is the possibility of securely attaching the desired tool to the working surface—as the rubbing/polishing layer—in a removable manner, such that on the one hand the easy changing of the medium is guaranteed, and on the other hand the connection is sufficiently strong, so that the severing forces generated through the operation of the device do not result in a detachment of the rubbing/polishing layer.

An eccentric tappet, 3, is connected to the tool mounting in a manner such that a turning of the eccentric tappet, 3, around its rotation axis, D, results in setting the tool mounting in motion. The eccentric tappet, 3, is formed in a manner such that it can be connected to the tool reception site of a motor-driven machine and by means of this motor-driven machine can be set in motion around its rotation axis, D. A driver-peg, 4, located on the eccentric tappet, which is set in motion around a determinate stretch of the rotation axis, D, is inserted into an interior ring of a journal bearing, 6, which in turn is positioned over an exterior ring in the tool mounting, 2. The outer side of the tool mounting, as well as its working surface, is sunken somewhat in the region of the journal bearing, 6, so that neither the driver-peg, 4, nor the journal bearing, 6, project outwards over the working surface.

The connection between the peg and the interior ring can be achieved for example by an elastic extension of the end of the driver-peg, 4, which—after being put through the interior bearing ring—is halted and remains in a resting position at the edge of the circumference. Alternatively, either a securing of the connection through screws, or by some other means, can also be chosen here, so as to prevent the driver-peg from sliding out of the interior ring. The driver-peg, 4, in connection with the bearing, 6, constitutes a second rotation axis, E, which is set over against the rotation axis, D. The turning of the eccentric tappet, 3, around the rotation axis, D, is conducive to a circular, vibratory movement of the tool mounting. Roller bearings are, for example, one possible type of bearing that may be used; however, glide bearings are also possible. The bearings can be pressed into a section on the rear side of the tool mounting, or be connected to the latter in some other suitable manner.

The connection of the eccentric tappet, 3, with the tool reception site of the respective motor-driven machine occurs preferably in a manner such that the eccentric tappet can be connected to the with the tool reception site so as to allows it to be universally movable. This result may be achieved by means of a ball-joint connection, 7. The polishing machine represented in accordance with either DE 44 47 162 A or U.S. Pat. No. 6,244,943 B1, whose demonstrations with respect to the connection between the tool and the movable tool reception site are included here by reference, possesses for example a shaft extension, 9, that is connected to, or can be connected to, a rotating tool reception site, whose axial end, 8, extending outside of the apparatus, is formed in a sphere-like fashion. Accordingly, the eccentric tappet of the device exhibits a connection component with a spherical section, 10, for connecting to this machine, into which the spherically formed termination of the shaft extension can be inserted. The transference of torque from the shaft extension onto the eccentric tappet occurs for example by way of radial projections on the spherically formed of the shaft extension, which intervene in corresponding sections in the spherical section of the eccentric tappet, and nevertheless make possible a movement of the ball-joint connection.

In the implementation mode exhibited, which is specifically conceived for co-action with the polishing machine represented, the connection component is integrally formed with the eccentric tappet as a ring-like protuberance. This protuberance either wholly or partially surrounds the spherical section, 10, and the spherical section extends itself outward in a cone-like fashion to the edge of the protuberance. On the outer periphery of the ring-like protuberance, there is formed a radial section, by way of which the connection component—being at rest and removable—can be connected to an interior ring as well as to an interior shell of a bearing ring of the machine, which makes possible the universal movability of the tool reception site. Grooves are envisioned as distributed on the outer periphery, by way of which the connection component can be connected to projections planned for location at the spherically formed end of the shaft extension.

The transfer of torque from the shaft extension, as well as from tool reception site of the drive machine, onto the connection component and eccentric tappet takes place in the best manner, therefore, by way of a connection that—with a simultaneous possibility of turning movement in the tool mounting, and consequently also in the eccentric tappet—determines the form and/or intensity of that movement.

In a certain potential modification, which is not represented here, the shaft extension with the spherical axial continuance can also be utilized as a separate junction-piece or adapter, in order to make possible—for example—a connection of the device proposed in the invention to a commercial power drill, or of a motor-driven screwdriver. In this case, the device mounting must be still further modified, in such a way as to make possible a firm connection with the housing of each respective machine.

The tool mounting is positioned in relation to the device mounting in such a way that it can be tilted, and is equipped with a mechanism that essentially prevents the tool mounting from turning about the rotation axis, D, of the eccentric tappet. This mechanism for preventing the rotation of the tool mounting exhibits a primary peg, 11, that pushes through a oblong section, 13, in the device mounting, 1, where the primary peg, 11, and the oblong section, 13, have measured dimensions such that the primary peg can move in relation within the oblong section when the tool mounting exhibits tilting movement relative to the device mounting, and yet does not move out of this oblong section, and, moreover, in all positions prevents the tool mounting from rotating around the rotation axis, D.

As a general rule, the region within which the tilting movement of the tool mounting is possible is determined by the tilting potential of the eccentric tappet around the tool reception site of the machine, so that the peg and the oblong section must be coordinated only here. Additionally, if necessary, an extension can be envisioned at the axial end of the primary peg that prevents the peg from coming out of the oblong section, and in this way definitely delimits the region within which tilting movement is possible.

Between the tool mounting and the device mounting at least one elastic element is envisioned, that presses away the tool mounting in the direction of the device mounting. In the example shown, a coil, 12, positioned around the primary peg to achieve this end, is shown between the tool mounting and the device mounting. The elastic element produces a counter-force to the weight of the device, and of the drive machine, as well as to the forces that are exerted by a user in the various tilt-positions of the machine, and prevent the tool mounting and the device mounting from colliding. Furthermore, a transference of the movement of the tool mounting to the drive machine, and to the hands of the users, is prevented, or at least minimized; and at the same time the universal tilting movement of the tool mounting is made possible, relative to the machine, as well as in relation to the attached device mounting (as indicated in FIG. 1). Moreover, oscillatory movement is allowed by reason of the movement of the eccentric tappet.

An elastic material in the form of a cushion, or the like, can also be utilized as the elastic component, fulfilling the requirements of the device mentioned previously. Moreover, several elastic elements can be distributed over the surface of the tool mounting, in order to achieve a uniform support for the tool mounting. In the example shown, the elastic element, as well as the eccentric tappet, (3), are symmetrically arranged relative to a plane of symmetry of the device, which extends through rotation axis, D, of the eccentric tappet. Even the oblong section, 13, for the primary peg, 11, is extended within this plane of symmetry.

U.S. Pat. No. 6,244,943 issued on Jun. 12, 2001, and is entitled "Surface-Processing Apparatus." The add-on devices disclosed in this patent application may, in one exemplary application of the present invention, be designed for specific use with the apparatus disclosed in this patent. The content of this patent is incorporated by reference into this application as if fully set for herein.

From the foregoing it will be observed that the numerous modifications and variations can be effectuated without departing from the true spirit and scope of the novel concepts of the present inventions. It is to be understood that no limitation with respect to the specific embodiments illustrated is intended or should be inferred. The disclosure is intended to cover by the appended claims all such modifications as fall within the scope of the claims.

What is claimed is:

1. A device for the treatment of surfaces, comprising:

a device mounting which is securely positionable in and removable at will from a casing of a drive machine;

a tool mounting that is especially designed for either a rubbing or polishing instrument and that is installed relative to the device mounting in such as way as to be capable of being titled;

an eccentric tappet that is connected to the tool mounting in a manner such that a rotation of the eccentric tappet around a rotation axis of the tappet sets the tool mounting in motion; and a mechanism which prevents the tool mounting from rotating about the rotation axis of the eccentric tappet and which, at the same times, allows for titling movement of the tool mounting relative to the device mounting.

2. The device of claim 1, wherein the mechanism for preventing the rotation of the tool mounting includes at least one guiding peg which pushes through an oblong section in the device mounting where the guiding peg and the oblong section have measured proportions such that the guiding peg is moveable within the oblong section when the tool mounting exhibits tilting movement relative to the device mounting.

3. The device of claim 1, wherein at least one elastic element is located between the tool mounting and the device mounting which presses away the tool mounting in the direction of the device mounting.

4. The device of claim 3 wherein the elastic element comprises a spring which is inserted between the tool mounting and the device mounting.

5. The device of claim 4, wherein the spring is arranged around at least one guiding peg.

6. The device of claim 3, wherein the elastic element, as well as the eccentric tappet, is symmetrically arranged relative to a plane of symmetry of the device, which extends through rotation axis of the eccentric tappet.

7. The device of claim 1 wherein the tool mounting exhibits an essentially flat working surface on an outer side for the reception of a tool such as a rubbing or polishing layer, and wherein the outer side exhibits at least one apex, formed by two lateral edges, a sharp angle being formed between the two lateral edges.

8. The device of claim 7, wherein the essentially flat working surface of the tool mounting for the reception of a tool exhibits approximately a circular form.

9. The device of claim 1, wherein the eccentric tappet is connectable to a rotating tool reception of a motor-driven machine for movement around its rotation axis.

10. The device of claim 9, wherein the eccentric tappet is connectable to a tool reception of a motor-driven machine for universal motion.

11. The device of claim 10, wherein the eccentric tappet is connectable to the motor-driven machine via a ball-joint connection for universal movement.

12. The device of claim 11, wherein the eccentric tappet possesses a connection component with a spherical section, a spherically formed axial end of a connected shaft extension being insertable into the spherical section.

13. The device of claim 12, wherein the connection component is integrally designated with the eccentric tappet as a ring-like protuberance which at least partially surrounds the spherical section.

14. The device of claim 13, wherein the spherical section extends itself outward in a cone-like fashion to an edge of the protuberance.

15. The device of claim 13, wherein a radial section is formed on the outer periphery of the ring-like protuberance, which allows the connection component to be connected to an interior ring of a bearing ring of the tool reception site.

16. The device of claim 13, wherein grooves are distributed on the outer periphery of the protuberance which allow the connection component to be connected to projections located at the spherically formed end of the shaft extension.

17. A device for the treatment of surfaces, comprising:

a device mounting which is securely positionable in and removable at will from the casing of a drive machine;

a tool mounting that is especially designed for either a rubbing or polishing instrument and that is installed relative to the device mounting in such as way as to be capable of being titled;

an eccentric tappet that is connected to the tool mounting in a manner such that a rotation of the eccentric tappet around a rotation axis of the tappet sets the tool mounting in motion;

a mechanism which prevents the tool mounting from rotating about the rotation axis of the eccentric tappet and which, at the same time, allows for titling movement of the tool mounting relative to the device mounting; and wherein the eccentric tappet is designed so that it is connectable to a motor-driven machine via a ball-joint connection for universal movement.

18. The device of claim 17, wherein the eccentric tappet possesses a connection component with a spherical section, a spherically formed axial end of a connected shaft extension being insertable into the spherical section, wherein the connection component is integrally designated with the eccentric tappet as a ring-like protuberance which at least partially surrounds the spherical section, wherein the spherical section extends itself outward in a cone-like fashion to an edge of the protuberance, wherein, on the outer periphery of the ring-like protuberance, there is formed a radial section which allows the connection component to be connected to an interior ring of a bearing ring of the tool reception site, and wherein grooves are distributed on the outer periphery of the protuberance which allow the connection component to be connected to projections located at the spherically formed end of the shaft extension.

19. A device for the treatment of surfaces, comprising:

a device mounting which is securely positionable in and removable at will from a casing of a drive machine;

a tool mounting that is especially designed for either a rubbing or polishing instrument and that is installed relative to the device mounting in such as way as to be capable of being titled;

an eccentric tappet that is connected to the tool mounting in a manner such that a rotation of the eccentric tappet around a rotation axis of the tappet sets the tool mounting in motion;

a mechanism which prevents the tool mounting from rotating about the rotation axis of the eccentric tappet and which, at the same time, allows for titling movement of the tool mounting relative to the device mounting; and wherein the mechanism for preventing the rotation of the tool mounting includes at least one guiding peg which pushes through an oblong section in the device mounting where the guiding peg and the oblong section have measured proportions such that the guiding peg is moveable within the oblong section when the tool mounting exhibits tilting movement relative to the device mounting.

20. A device for the treatment of surfaces, comprising:

a device mounting which is securely positionable in and removable at will from a casing of a drive machine;

a tool mounting that is especially designed for either a rubbing or polishing instrument and that is installed relative to the device mounting in such as way as to be capable of being titled;

an eccentric tappet that is connected to the tool mounting in a manner such that a rotation of the eccentric tappet around a rotation axis of the tappet sets the tool mounting in motion;

a mechanism which prevents the tool mounting from rotating about the rotation axis of the eccentric tappet and which, at the same time, allows for titling movement of the tool mounting relative to the device mounting;

wherein at least one elastic element is located between the tool mounting and the device mounting which presses away the tool mounting in the direction of the device mounting;

wherein the elastic element comprises a spring which is inserted between the tool mounting and the device mounting; and wherein the spring is arranged around at least one guiding peg.

* * * * *